United States Patent [19]

Doudet

[11] 4,345,450

[45] Aug. 24, 1982

[54] REVERSE EXTRUSION PRESS

[75] Inventor: Michel Doudet, Epone, France

[73] Assignee: Secim, Courbevoie, France

[21] Appl. No.: 847,942

[22] Filed: Nov. 2, 1977

[30] Foreign Application Priority Data

Nov. 10, 1976 [FR] France ..... 76 33870

[51] Int. Cl.[3] ..... B21C 23/00; B21C 23/21; B21C 27/00

[52] U.S. Cl. ..... 72/273.5; 72/265; 72/272

[58] Field of Search ..... 72/253 A, 253 R, 255, 72/263–265, 272

[56] References Cited

U.S. PATENT DOCUMENTS 3,664,168 5/1972 Shtin ..... 72/265

FOREIGN PATENT DOCUMENTS 2303617 10/1976 France ..... 72/255
49-59759 6/1974 Japan ..... 72/265

OTHER PUBLICATIONS

"Indirect Extrusion of Non-Ferrous Tubes", read at ASM Metalworking Forum, Apr. 5–7, 1976, by F. J. Zilges, pp. 1–28.

*Primary Examiner*—Francis S. Husar
*Assistant Examiner*—D. M. Gurley
*Attorney, Agent, or Firm*—Pollock, Vande Sande & Priddy

[57] ABSTRACT

In an indirect extrusion drawing press comprising a fixed crosspiece to which is fixed a tubular ram which is perforated by an axial orifice for the removal of the wire, a fixed bearing member, a movable crosspiece which is moved by a main jack bearing against the bearing member, a container in which is provided the bore of the billet, and which is interposed between the movable crosspiece and the ram, and a container bottom which is placed on the movable crosspiece along the axis of extrusion and which presses against the container during extrusion, the container being driven towards the ram by the movable crosspiece. A mechanism is provided for fixing the container relative to the movable crosspiece during extrusion so that auxiliary jacks, provided for moving the container independently of the crosspiece, can be used during extrusion to assist the main jack.

4 Claims, 8 Drawing Figures

REVERSE EXTRUSION PRESS

FIELD OF THE INVENTION

The invention relates to an improved indirect extrusion press.

PRIOR ART

Indirect extrusion consists in pushing a billet or ingot of metal, placed in a bore, towards a fixed tubular ram which carries a die at its end and which engages progressively in the bore of the container at the rate at which extrusion takes place, the metal forming a wire which is removed through an axial bore of the ram.

The indirect extrusion presses thus normally comprise a fixed crosspiece to which is fixed the tubular ram which is perforated by an axial orifice for the removal of the wire, a fixed bearing member, a movable crosspiece which is moved by a main jack bearing against the bearing member, a container in which is provided that bore of the billet, and which is interposed between the movable crosspiece and the ram, and a container bottom which is placed on the movable crosspiece along the axis of extrusion and which presses against the container during extrusion, the container being driven towards the ram by the movable crosspiece.

For the various extrusion operations and especially for positioning the billet in the bore, the actual extrusion and thereafter the removal of the metal slug remaining at the end of the extrusion operation, it is necessary to provide auxiliary jacks which make it possible to move the movable crosspiece and the container independently of one another and without using the main jack. In general, the container is placed on a so-called "cradle" crosspiece which is connected by control rods, passing through the movable crosspiece and the bearing member, to a crosspiece placed at the back of the bearing member and actuated either by a single double-acting jack or by one or two groups of jacks which move the container in one direction or the other along the extrusion axis.

Hitherto, it has not been proposed to use the auxiliary jack which moves the container for the extrusion, because it would have been difficult to feed the auxiliary jacks and the main thrust jack in such a way that they move at the same speed. Consequently, during extrusion, the auxiliary jacks are simply connected to the hydraulic tank and not only is the thrust which they would be capable of producing not utilized, but also they exert a not insignificant resistance to movement of the movable crosspiece.

SUMMARY OF THE INVENTION

It is an object of the invention to provide a press in which it is possible to use the auxiliary jacks during the extrusion.

According to the invention, there is provided a indirect extrusion press having a drawing axis and comprising a fixed crosspiece; a tubular ram mounted on said fixed crosspiece and supporting a die; a fixed member; a movable crosspiece movable along said extrusion axis between said fixed bearing member and said fixed crosspiece; a container providing a bore for a billet to be extruded and movable between said movable crosspiece and said fixed crosspiece, said bore being engageable on said ram; a main jack operable to cause extrusion by moving said movable crosspiece and said container towards said ram; and an auxiliary jack operable to move said container independently of said main jack; fixing means operable to said container relative to said movable crosspiece during extrusion; said auxiliary jack being operable during extrusion so as to add its action to that of said main jack.

Indirect extrusion presses are frequently used for extrusion of tubes. In this case, needles are placed along the extrusion axis, which needles pass through the billet as far as the orifice of the die, so that during extrusion a tube of metal forms between the needle and the die.

If extrusion is carried out by the direct method, the billet is pierced by means of the needle. However, this is not possible if the indirect method is used with the currently existing presses.

In fact, it is necessary, before extrusion, to force the billet inside the bore between the ram and the bottom of the container. It is then difficult to pierce the billet by means of the needle because this results in an elongation of the billet and normally there is only one relative position between the container and the movable crosspiece. It is for this reason that pre-pierced billets have hitherto been used in indirect extrusion.

It is a further object of the invention to provide a press which overcomes this disadvantage and make it possible to pierce the billet after it has been forced into its bore, even in indirect extrusion.

To this end, said fixing means comprises a lockable control means for controlling the position of said container relative to said movable crosspiece.

BRIEF DESCRIPTION OF THE DRAWING

The invention will now be described with reference to embodiments thereof, given by way of example only, and illustrated on the accompanying drawings.

In the drawings.

DETAILED DESCRIPTION

Figure 1:
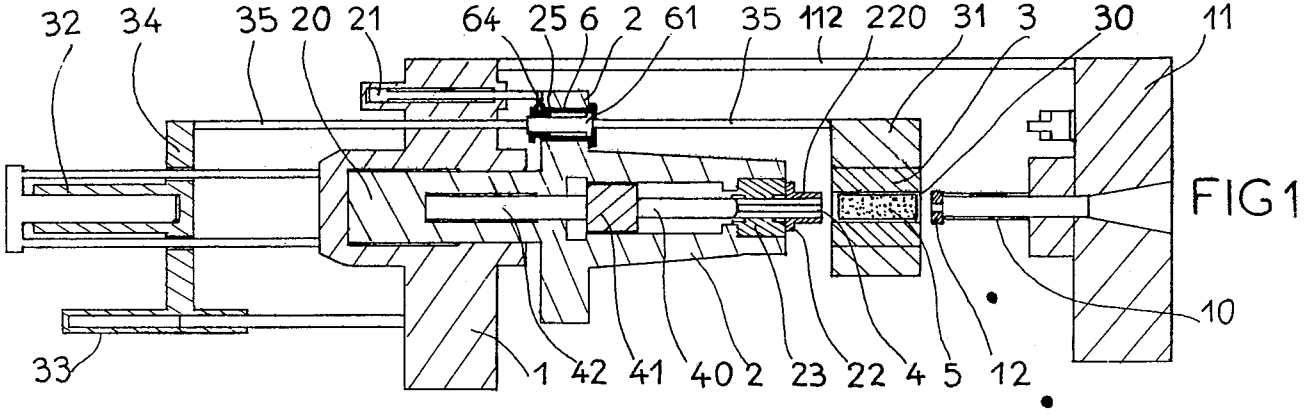
FIG. 1 shows, in longitudinal section, an embodiment of a press for indirect extrusion of tubes according to the invention, in the position of introduction of a billet.

The press shown in FIGS. 1 to 5 comprises, in conventional manner, a bearing member 1 connected to a fixed crosspiece 11 by tie rods 112, a movable crosspiece 2 actuated by a main jack 20 and adjustment jacks 21, and a container 3 mounted on a cradle 31 and movable between the movable crosspiece 2 and the fixed crosspiece 11 by means of jacks 32 and 33 which, for example, act on a crosspiece 34 placed behind the bearing member 1 and connected to the cradle 31 by tie rods 35.

The container 3 is provided, along the axis of the press, with a bore 30 which can receive a tubular ram 10 equipped, at its end, with a die-carrier bush 12 which has an external diameter slightly less than that of the bore 30. At the side which faces away from the ram, the bore 30 can be closed by a container bottom 22 carried by the movable crosspiece.

The bottom 22 of the container is mounted on a slide block 23 which carries a needle 4 for extrusion of the tube, the needle 4 being mounted on a rod 40 carried by a support beam 41 which carries the bottom of the container.

The beam 41 on which the extrusion needle 4 rests can be moved parallel to the extrusion axis by a jack 42 which is advantageously placed in a bore formed in the rod of the main jack 20.

In the position shown in FIG. 1, a billet 5 is inside the bore 30.

When the press is in this condition, in the conventional method, the movable crosspiece 2 is advanced and the bottom 22, pressing on the container 3, drives the latter so that the bore 30 engages the ram. In continuing the movement, the billet 5 is compressed between the rammer and the bottom of the container so that it adheres to the walls of the bore. If it is desired at this point to pierce the billet, it is necessary to move the movable crosspiece back to provide the billet with the space required for undergoing the increase in length which corresponds to the orifice pierced in the latter. Hitherto, this operation was not possible and it is for this reason that pre-pierced billets were used in indirect extrusion presses.

In the press shown in the drawings, means for firmly fixing the container to the movable crosspiece is provided and comprises, as shown, a fixed case 6 which is mounted to slide along the control rod 35 of the cradle 31 of the container. The case 6 forms the body of a jack whose piston 61 is fixed to the rod 35. Externally, the case has a cylindrical shape and is received in a bore 25, of slightly greater diameter, in the crosspiece 2.

Figure 5:
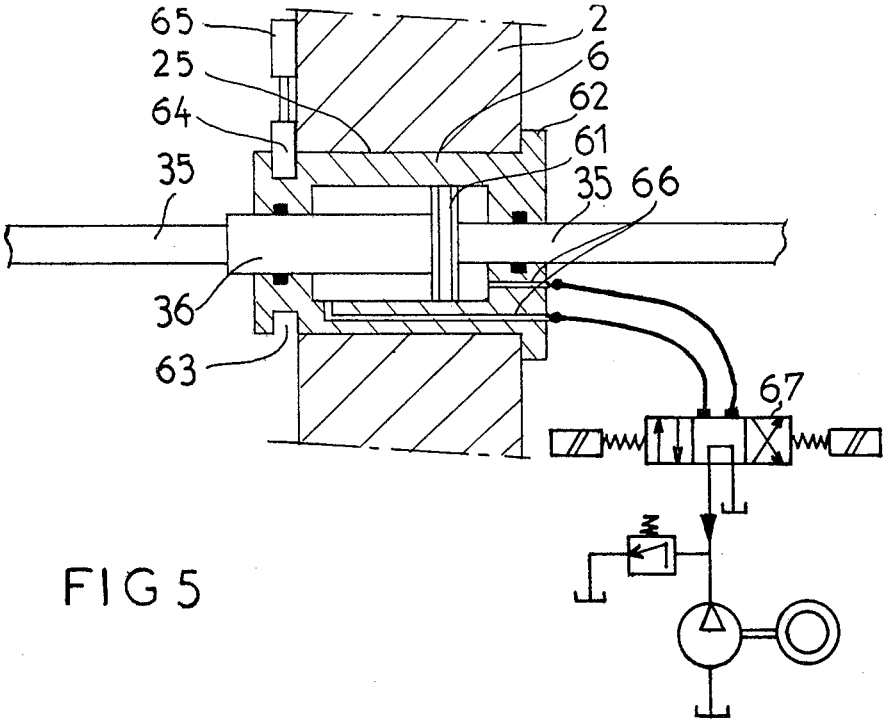
FIG. 5 is a detail view of the means for controlling the position of the container of the press of FIG. 1.

As is shown in detail in FIG. 5, to enable the case 6 to be firmly fixed to the crosspiece 2, the case 6 is provided, on that end closer to the container, with a flange 62 which abuts the front wall of the crosspiece 2. On the opposite end, the case 6 is provided with a groove 63 in which a bolt can be engaged, the bolt being in the form of a fork 64, which is mounted to slide along the rear wall of the movable crosspiece 2 and which can be actuated by a double-acting jack 65 mounted on the crosspiece 2.

Pipelines 66 are provided for feeding the jack comprising the piston 61 with oil from either side of the piston 61.

Of course, gaskets are provided between the case 6 and the rods, and the assembly is actuated by a hydraulic system which has been shown schematically in FIG. 5 and which it appears unnecessary to describe in detail.

The bottom 22 of the container possesses, on the container side, a cylindrical extension 220 of slightly smaller cross-section than that of the bore 30, so as to be engageable in the bore 30, this extension having a length greater than the length of that part of the bore corresponding to the elongation of the billet during piercing. This extension 220, as well as the slide block 23, are provided, on the extrusion axis, with a bore in which the needle 4 and its support 40 can slide. The piston 61 is arranged to be movable inside the case 6 over a length greater than that of the extension 220.

Figure 2:
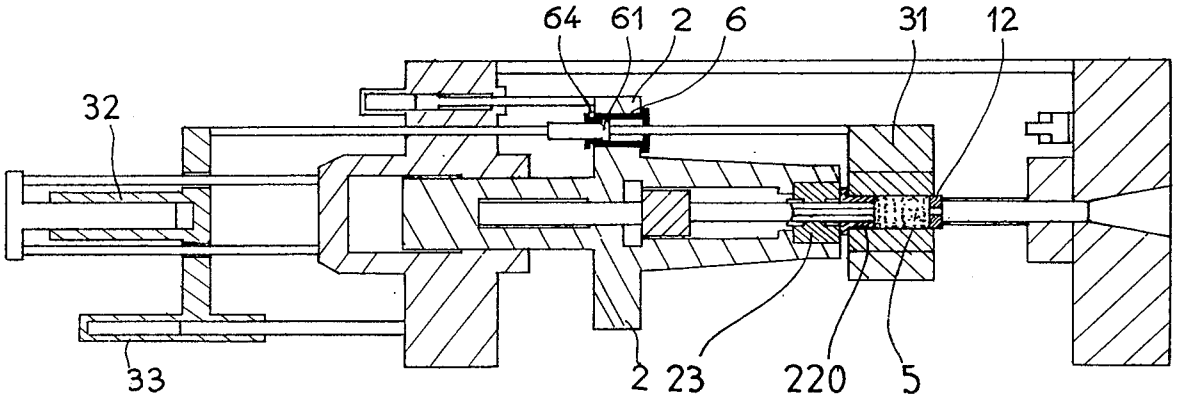
FIG. 2 shows the press of FIG. 1 in the position of forcing the billet into the container.
Figure 3:
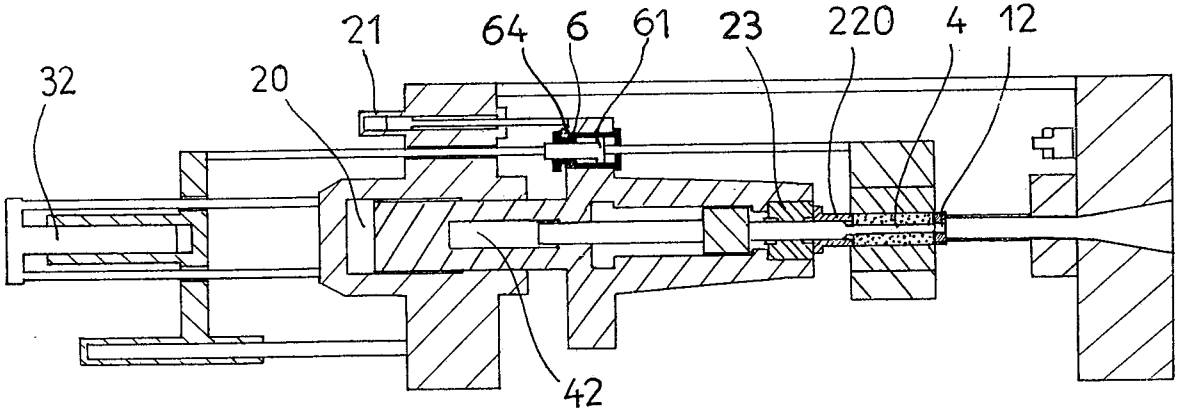
FIG. 3 shows the press of FIG. 1 in the position of piercing the billet.

In the position shown in FIG. 1, the bore 30 contains a billet 5. If the movable crosspiece 2 is now advanced, the extension 220 engages inside the bore 30 and pushes the billet 5 towards the ram 10. The piston 61 slides inside the case 6 driven by the crosspiece 2, and when it arrives at the end of its stroke, the bottom 22 abuts the container, as shown in FIG. 2; the exact position of the bottom 22 relative to the container can be regulated by means of spacers. When the movable crosspiece is moved further forward, the billet 5 is wedged between the extension 220 and the die carrier bush 12 and is forced into the bore 30, the latter engaging slightly over the die carrier bush 12. The jacks 32 and 33 for the adjustment of the cradle 31 are now locked and the movable crosspiece 2 is withdrawn slightly, by the distance required for elongation of the billet during piercing. The container thus remains in position, and the piston 61 slides inside the case 6 and assumes the intermediate position shown in FIG. 3. As has been indicated, the length of the extension 220 is such that, in this position, it still remains slightly engaged in the bore 30, so as to close the latter. Piercing can now be carried out by pushing forward the needle 4 by means of the jack 42 which is located, as has been shown, within the main jack, which is blocked hydraulically. During this operation, the two chambers of the jack in the case 6 are closed, and the valve 67 of the feed circuit is in the position shown in FIG. 5.

Since the jack in the case 6 has chambers of small volume, the piston 61 can be taken to be fixed relative to the case, when the chambers are closed. The container 3 is thus locked relative to the movable crosspiece and there is therefore no risk of it being moved while the needle is pushed in until it reaches the extrusion position shown in FIG. 3, in which position the end of the needle slightly penetrates into the die 12.

Extrusion can now be carried out by pushing the movable crosspiece 2 towards the fixed crosspiece 11 by means of the main jack 20. As the container is firmly fixed to the movable crosspiece by virtue of the locked jack 6, it is possible also to push it by means of the jack 32, the force of which is thus added to the force of the main jack without it being necessary to provide means for coordinating the action of the two jacks.

At the end of the extrusion operation, the container 3 is completely engaged over the ram. A tube 50 has thus been formed, and a slug 51 remains between the die carrier bush and the bottom of the container, and must be removed. To do this, the jack 32 can be actuated so as to push the container towards the fixed crosspiece 11, as far as the stops 13, which makes it possible to force the slug 51 out of the bore 30. In this position, the jack 61 is at the bottom of its stroke in the extrusion direction.

Figure 4:
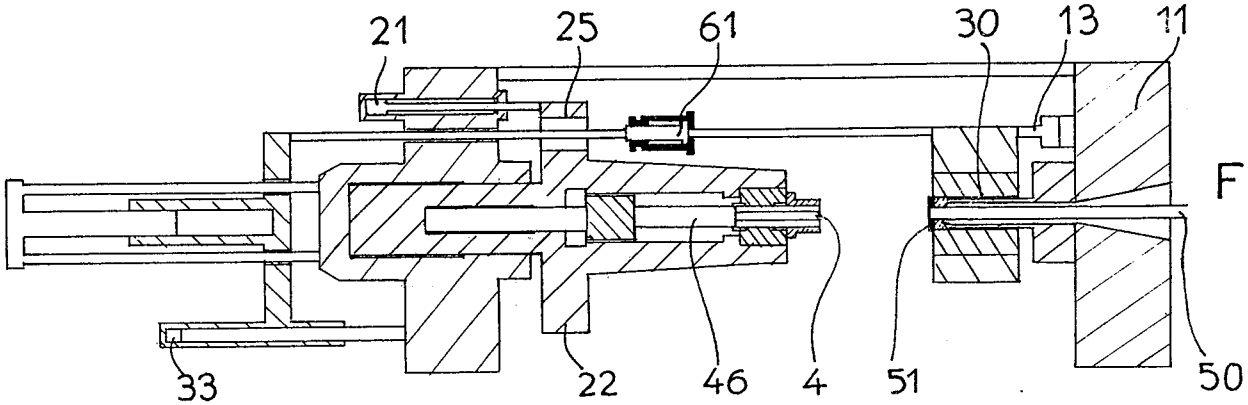
FIG. 4 shows the press of FIG. 1 in the position at the end of the extrusion operation.

The container can now be uncoupled from the movable crosspiece by withdrawing the bolt 64, and the movable crosspiece 2 is drawn back by means of its adjustment jacks 21. As the container remains locked by its own adjustment jacks, the case 6 is withdrawn from the seat 25 and the position of FIG. 4 is reached. The movable crosspiece 2 has been drawn back to allow the passage of shears for removing the slug 51. Furthermore, the needle 4 has been reintroduced into the movable crosspiece.

The container can now be withdrawn by means of the jacks 33 so as to disengage the ram and, for example, replace the latter by a ram which scrapes out the lining which has remained in the container. The following operations are conventional and depend on the drawing cycle which is adopted.

When a new billet has been introduced into bore 30, with the container being in the position of FIG. 1, the case 6 has been reintroduced into the bore 25 and is fixed to the crosspiece 2 by means of the bolt 64. The extrusion cycle as described above can recommence.

The above described press can be subjected to numerous variations.

First of all, even though the improvements according to the invention are particularly useful in the case of a tube extrusion press because they make it possible to pierce the billet in indirect extrusion, the detachable fixing of the container onto the movable crosspiece is also useful in a bar extrusion press because it makes it possible to add, to the force developed by the main drawing jack, the force which is attributable to the jack which moves the container.

Figure 6:
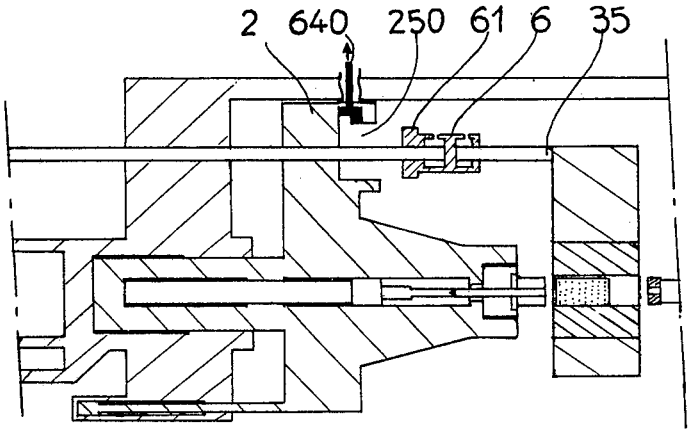
FIG. 6 is a view of a modification of the press of FIG. 1.

In FIG. 6 there is shown a modification in which the case 6 is mounted so as to slide on the container control rod 35 but does not pass through the movable crosspiece 2 in the fixed position. The case 6 is merely provided with a flange 61 located on that end adjacent the movable crosspiece, which flange engages in a bore 250 provided on the face of the movable crosspiece which is directed towards the container. A bolt 640 actuated by a jack and mounted to slide transversely to the extrusion axis, fixes the flange 61 relative to the movable crosspiece so that the case 6 can be moved with the crosspiece both in the extrusion direction and in the opposite direction.

Figure 7:
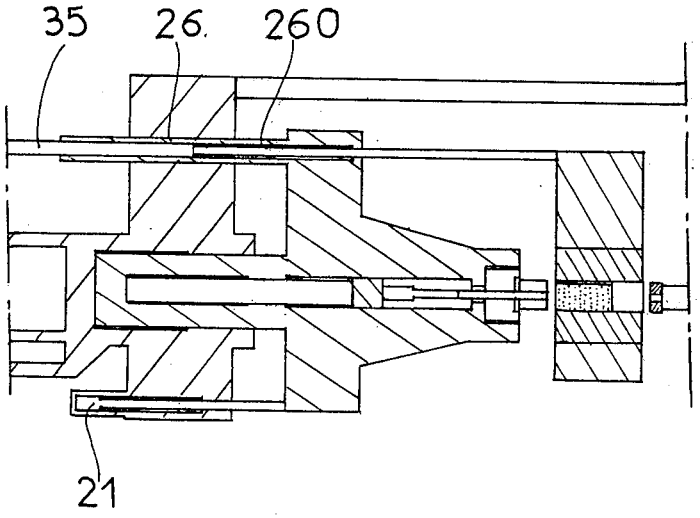
FIG. 7 is a view of another modication of the press of FIG. 1.

In the embodiment of FIG. 7, the means for fixing the container relative to the crosspiece comprises a cylindrical chamber 26 which is fixed to the movable crosspiece and in which the adjustment rod 35 of the container slides, the adjustment rod 35 having an enlarged diameter towards that end closer to the fixed crosspiece so as to produce, within the cylindrical chamber 26, an annular space 260 which constitutes the chamber of a jack. In this case, the cylindrical chamber 26 must be of greater length than the maximum stroke of the container relative to the crosspiece. As a result, the volume of oil enclosed in the chamber 260 of the jack is greater than in the preceding case, and because of the compressibility of the oil, the position of the container is not fixed with as much precision relative to the movable crosspiece. On the other hand, the embodiment is a little simpler.

Finally, the means for fixing the container relative to the movable crosspiece does not necessarily need to function hydraulically, though this solution is a particularly practical one, in view of the fact that the press functions hydraulically and that the above described fixing means only introduce a minimal modification of the hydraulic circuit.

Figure 8:
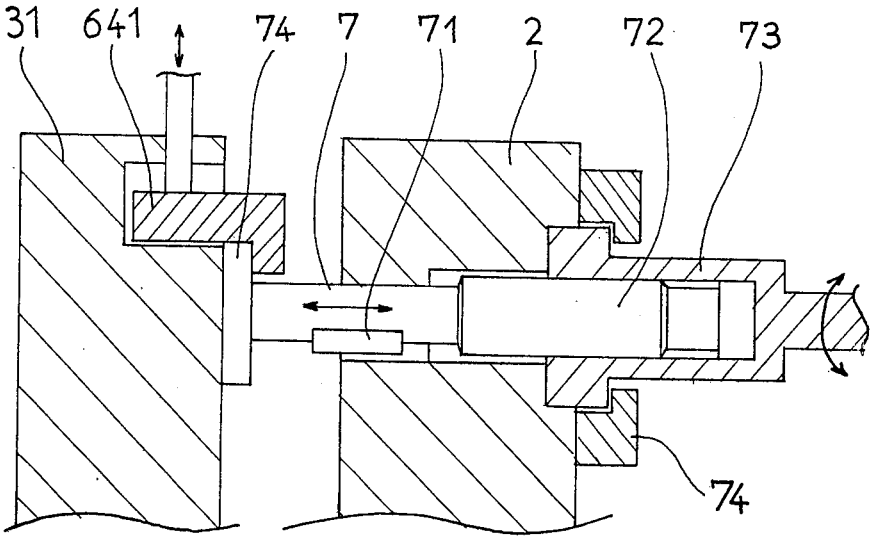
FIG. 8 represents a mechanical version of the means of regulating the position of the container.

FIG. 8 shows, by way of example, a press with a mechanical locking means. In this case, a rod 7 is provided on the movable crosspiece 2, which rod can travel parallel to the extrusion axis, but which is prevented from turning by a key 71. The rod 7 is provided with a threaded portion 72 which meshes with a nut 73 mounted for rotation about its axis on the movable crosspiece, a flange 74 being provided to prevent longitudinal movement of the nut 73. The nut 73 is rotated by a motor which is not shown. At the end of the rod 7 there is provided a plate 74 which abuts the cradle 31 carrying the container and which can be locked in this position by a bolt 641.

It will be seen that by actuating the nut 73, it is possible to regulate the length of the rod 7 so as to fix the position of the container relative to the movable crosspiece.

Of course, the invention can include many other variants, in particular variants using equivalent means.

In each of the above described embodiments only a single fixing means for the container relative to the movable crosspiece has been described and shown in the drawings. However, the container is generally actuated by several control rods and it would be possible to associate identical cases with each control rod, each case engaging in a bore of the movable crosspiece. In this arrangement, the hydraulic circuit would control the simultaneous and identical movements of all the cases.

I claim:

1. An indirect extrusion press for tubes comprising: a fixed support and a fixed crosspiece; a tubular ram mounted on said fixed crosspiece and supporting a die centered on an extrusion axis; a movable crosspiece movable along said extrusion axis between said fixed support and said fixed crosspiece; a container, provided with a bore for a billet, engagable on said ram and movable between said movable crosspiece and said fixed crosspiece; a needle for piercing the billet and extrusion of the tubes, mounted on the movable crosspiece in the extrusion axis; a closing bottom of the container mounted on the movable crosspiece and comprising, with respect to the container, a cylindrical extension capable of being enclosed in the bore for ramming of the billet and having a length greater than the elongation of the billet during piercing; a main jack for the displacement of the movable crosspiece and of the container toward the ram; at least two auxiliary jacks attached to the support and connected, respectively to the movable crosspiece and to the container by the operating rods parallel to the extrusion axis; and at least one means of connecting the container with the movable crosspiece in an adjustable position, defined by a jack comprised of two displaceable elements, one with respect to the other parallel to the extrusion axis along a length greater than the elongation of the billet during piercing, control means and locking means for one of these elements with respect to the other and means for connecting one of these elements to the movable crosspiece and the other element to the container, at least one of said connecting means being detachable.

2. An indirect extrusion press according to claim 1, wherein: the means for connecting the container with the movable crosspiece is a hydraulic jack comprising a piston connected to an operating rod of the container and being displaceable along a length greater than that of the extension of the bottom of the container on the interior of a cylindrical box, defining on both sides of the piston, two chambers having small volume whereby the piston is attached with respect to the box when the chambers are closed, the movable crosspiece being provided with connecting means detachable from the box.

3. An indirect extrusion press according to claim 2, wherein: the movable crosspiece is provided with a bore in which the cylindrical box can be fitted, the latter being provided with a coupling part of a bolt mounted on the movable crosspiece and defining the means for detachable connection of the box.

4. An indirect extrusion press according to claim 2, wherein: the means for connecting the container in adjustable position is a mechanical jack comprising a rod displaceable parallel to the extrusion axis being prevented from rotation, said rod being provided with a threaded part engaging a rotary screw, locked longitudinally on the movable crosspiece and adapted to rotate for regulation of the length of the rod, the container having detachable connecting means at the end of the rod.

* * * * *